US006288490B1

(12) United States Patent
Popov

(10) Patent No.: US 6,288,490 B1
(45) Date of Patent: Sep. 11, 2001

(54) FERRITE-FREE ELECTRODELESS FLUORESCENT LAMP

(75) Inventor: Oleg Popov, Needham, MA (US)

(73) Assignee: Matsoshita Electric Works Research and Development Laboratory Inc, Woburn, MA (US)

( * ) Notice: Subject to any disclaimer, the term of this patent is extended or adjusted under 35 U.S.C. 154(b) by 0 days.

(21) Appl. No.: 09/256,137

(22) Filed: Feb. 24, 1999

(51) Int. Cl.[7] ..... H01J 11/00
(52) U.S. Cl. ..... 313/607
(58) Field of Search ..... 313/607, 493, 313/17, 572, 197; 315/248

(56) References Cited

U.S. PATENT DOCUMENTS

| | | | | |
|---|---|---|---|---|
| 3,500,118 | | 3/1970 | Anderson | 315/57 |
| 4,010,400 | * | 3/1977 | Hollister | 315/248 |
| 4,171,503 | * | 10/1979 | Kwon | 315/248 |
| 4,240,010 | * | 12/1980 | Buhrer | 315/248 |
| 4,254,363 | * | 3/1981 | Walsh | 315/248 |
| 4,568,859 | | 2/1986 | Honkes et al. | 315/248 |
| 4,864,194 | | 9/1989 | Kobayashi et al. | 315/248 |
| 5,013,975 | | 5/1991 | Ukegawa et al. | 315/248 |
| 5,343,126 | | 8/1994 | Farrall et al. | 315/248 |
| 5,349,271 | | 9/1994 | van Os et al. | 315/248 |
| 5,726,523 | * | 3/1998 | Povov et al. | 313/161 |
| 5,834,905 | | 11/1998 | Godyak et al. | 315/248 |

* cited by examiner

*Primary Examiner*—Vip Patel
*Assistant Examiner*—Todd Reed Hopper

(57) ABSTRACT

An electrodeless fluorescent lamp comprises a glass closed-loop envelope filled with inert gas and mercury vapor at pressure of 0.1–5 torr. An induction coil of few turns and made from Litz wire is disposed on the outer surface of the lamp inside of the closed-loop envelope. A phosphor coating is disposed on the inner surface of the envelope surface and a reflective coating is disposed on the inner surface of the area adjacent to the induction coil.

21 Claims, 5 Drawing Sheets

FERRITE-FREE ELECTRODELESS FLUORESCENT LAMP

FIELD OF THE INVENTION

This invention relates to electric lamps and, more specifically, to fluorescent electrodeless lamps operated at low and intermediate pressures without the use of ferrites at frequencies from 20 kHz to 200 MHz.

BACKGROUND OF THE INVENTION

Electrodeless fluorescent lamps utilizing an inductively coupled plasma were found to have a high efficacy and lives which are longer than conventional fluorescent lamps that employ hot cathodes. The plasma that generates visible and UV light is induced in a glass (or quartz) envelope filled with inert gas such as argon, krypton at pressure of 0.1–2 torr and mercury vapor. To generate such a plasma at a frequency of 13.56 MHz, electrodeless lamps employ an induction coil positioned near the lamp envelope. The prior art teaches three basic approaches of coupling the induction coil and the lamp plasma at a frequency of 13.56 MHz.

The most simple coupling method is wrapping the induction coil around the envelope which was disclosed in U.S. Pat. No. 5,013,975 by Ukegawa et al. This approach provides good coupling between the coil and plasma, but has at least three disadvantages. The coil is exposed and radiates electromagnetic waves and therefore the lamp needs screening (mesh, special screening wire around the lamp, etc.). The lamp operation is very sensitive to the fixture's shape and size due to good capacitive coupling between the outside coil and the fixture. The lamp with a coil outside is not aesthetically attractive.

Another approach used for electrodeless lamps operated at a frequency of 13.56 MHz was suggested in U.S. Pat. No. 4,010,400 by Hollister, and U.S. Pat. No. 5,621,266 by Popov et al. The induction coil was inserted in a reentrant cavity located along the envelope axis. Such an arrangement provides a good coupling between the coil and the toroidal or cylindrical-shaped plasma. The coil is screened by the plasma so the introduction of the fixture does not affect the lamp performance. This approach has two disadvantages. The introduction of the reentrant cavity reduces the volume of the envelope filled with the plasma which results in a decrease of the lamp efficacy. Heating of the cavity walls and the adjacent coil by the plasma radiation requires special means for cooling the coil and walls. A slotted aluminum cylinder inserted in the reentrant cavity and welded to the lamp base is disclosed as a cooling means in U.S. Pat. No. 5,621,266 by Popov et al., and U.S. Pat. No. 5,698,951 by Maya et al. The same cylinder works also as a Faraday shield between the coil and the plasma, thereby reducing the energy of ions bombarding the cavity walls and, hence, improving the lamp maintenance.

The third approach that is suitable for the operation at 13.56 MHz is based on the utilization of a spiral coil attached to the bottom of the envelope as it is disclosed in U.S. Pat. No. 5,349,271 by Ron van Os et al., and U.S. Pat. No. 5,500,574 by Popov et al. This lamp provides good coupling between the coil and the plasma and does not cause the overheating of the coil and envelope walls adjacent to the coil. To increase the lamp light output, U.S. Pat. No. 5,500,574 teaches coating the bottom of the envelope with a reflective material. However, such approach also has a drawback in that it is difficult to manufacture lamps with a large bottom diameter, which restricts the lamp size.

The decrease of the driving frequency, f, from 13.56 MHz to 2.65 MHz, requires the increase of the magnetic field in the plasma, $B_{pl}$, that generates inductively coupled electric field in the plasma, $E_{pl}$. The increase of $B_{pl}$ could be achieved by the increase of the coil current, $I_{coil}$, or by the increase of the medium magnetic permeability, $\mu_{eff}$. The increase of $I_{coil}$ leads to the increase of coil power losses, $P_{loss}$, $$P_{loss}=(I_{coil})^2R_{coil},$$

where $R_{coil}$ is the resistance of the coil.

The increase of coil power losses reduces lamp power efficiency and, hence, lamp efficacy. Therefore, to keep the lamp efficacy high it is necessary to increase $B_{pl}$ by the increase of the medium permeability, $\mu_{eff}$, by the introduction of a ferrite core.

In electrodeless lamps disclosed in U.S. Pat. No. 4,568,859 by Houkes et al., and U.S. Pat. No. 5,343,126 by Farrall et al., and operated at a frequency of 2.65 MHz, the ferrite core was introduced in the reentrant cavity along the envelope axis. The solenoidal induction coil was wrapped around the ferrite core, thereby substantially increasing the magnetic field in the plasma without sacrifice in the lamp efficiency. However, the ferrite core located in the reentry cavity needs to be cooled and maintained at a temperature below Curie point, T<300° C., which requires a cooling means. Moreover, the increase of lamp power to 100–200 W or higher requires the increase of the envelope diameter and the cavity length that makes cooling of the ferrite core and the coil very difficult.

The alternative approach that does not require coil and ferrite cooling was suggested by Anderson in U.S. Pat. No. 3,500,118, and developed by Godyak et al. in U.S. Pat. No. 5,834,905. The electrodeless fluorescent lamp comprises a closed-loop, tubular lamp ("Tokamak" shape), with one or several toroidal transformer cores being disposed around the lamp and an induction coil of several turns wound on the core. The induction coil is the prime winding and the plasma generated in the closed-loop tube is the second winding.

U.S. Pat. No. 5,834,905 teaches that the lamp tube diameter and the lamp discharge current should be high enough to provide low plasma electric field, $E_{pl}<0.5^{V}/_{cm}$, and, hence, low discharge voltage. The lower the discharge voltage, the lower the magnetic field needed to maintain an inductively coupled discharge, and, hence, the lower the power losses in the ferrite core. By employing a ferrite core with low power loss ($P_f/V_f<0.1$ W/cm$^3$) Godyak et al. achieved 94% power efficiency in a lamp operated at RF power of 150 W and at a frequency of 200 kHz.

However, the Anderson-Godyak approach with a ferrite core has a few disadvantages. The ferrite core is relatively expensive, and it requires special ferrite preparation of two thoroughly polished cuts and brackets to keep these surfaces firmly together. Also, a special strip (or wire) made from conductive material and electrically connected to the matching network must be disposed on the lamp tube to ignite a lamp.

The closed-loop lamp of small size (but without a ferrite core) was described in U.S. Pat. No. 4,864,194 by Kobayashi et al. Patentees disclosed a lamp envelope of two straight tubes connected with two hollow bridges and a box (or tube) with a partition that divides the box/tube in two parts. The lamp employs only a single turn as the induction coil. The one-turn coil is disposed around the outer periphery of the lamp.

As the material for the induction coil, patentees described a copper wire, a copper strip or copper foil. The use of only one coil turn (even of large length and diameter) restricts a coil inductance to small value of 1 $\mu$H and lower, and, hence, restricts the operating frequency range. Also, the power loss in the coil increases as the number of turns decreases. For the case when the coil diameter is much larger than coil height, the power loss in the coil is:

$$P_{loss}\ (E_{pl})^2 R_{coil}/k\ f\ (N_{coil})^2$$

Here k is the coupling coefficient between the coil and the plasma and $N_{coil}$ is the number of turns. Typically, k>0.6 for plasmas at pressure, p>100 mTorr and RF power, P>10 W.

It is seen from the above equation that $P_{loss}$ decreases as the number of turns increases, $P_{loss}$~$1/N_{coil}$ ($R_{coil}$ increases with $N_{coil}$ linearly). The operation with the single turn could be efficient (low ratio $P_{loss}/P_{lamp}$) only at high frequency of f>13.56 MHz. When the lamp is operated at lower frequency of 2–3 MHz, and lower, the coil with one turn consumes a considerable amount of RF power, making the lamp inefficient.

The induction coil in the lamp described in U.S. Pat. No. 4,864,194 is positioned outside of the lamp around the tube periphery. This location of the coil was chosen because the lamp was designed as a light source for a copying machine where the light was emitted through the inner surface of the tubes. For lamps used in indoor and outdoor applications, such as high ceilings, streets, malls, tunnels, etc., it is desirable to have the envelope's outer surface free of the coil so the coil does not interfere with the light radiated from the envelope. It is also important to note that the coil disposed outside the lamp has a capacitive coupling with the fixture that affects the lamp operation.

SUMMARY OF THE INVENTION

According to the present invention a novel approach is disclosed that results in an efficient ferrite-free electrodeless closed-loop lamp that is operated at low frequency (as low as 200 kHz) and has efficiency the same or comparable to that described in U.S. Pat. No. 5,834,905 (Godyak et al).

The invention comprises an electrodeless fluorescent lamp having a glass lamp envelope with an inner surface and an outer surface, and formed in the shape of a closed loop. A filling of an inert gas and at least one vaporous metal, such as mercury, cadmium, sodium, is placed in the envelope. The vapor pressure of the metal is maintained below 10 torr during operation. A protective coating is disposed on the inner surface of the envelope and a phosphor coating is disposed on the protective coating. An induction coil formed of a plurality of windings is disposed on the outer surface of the envelope and extends around the length of the closed loop forming the envelope. The coil covers only a small portion of the outer surface of the envelope. A radio-frequency power source coupled to the induction coil to ignite and maintain RF discharge in the envelope to generate plasma.

An object of the present invention is to design an efficient ferrite-free closed-loop electrodeless fluorescent lamp operating in a wide range of frequencies, from 50 kHz to 200 MHz, and a wide range of power, from 20 W to 2000 W.

Another object of the present invention is to design an induction coil that consumes an insignificant amount of RF power both in MHz and kHz range of RF frequency, so the efficiency of the lamp is the same or comparable to that of lamps described in U.S. Pat. No. 5,834,905.

Yet another object of the present invention is to locate an induction coil to minimize interference of the coil with the lamp radiation.

A further object of the present invention is to position the coil so as to provide the efficient coupling with the lamp plasma.

Another object of the present invention is to design a lamp with the coil so the fixture does not affect coil operation, thereby allowing the use of a lamp with different fixtures, but with the same matching network without changing the lamp operational conditions.

Yet another object of the present invention is to design a lamp that does not need a special provision and circuit for the ignition of the inductively coupled discharge even at low frequency of 100 kHz.

Another object of the present invention is to design an electrodeless ferrite-free lamp that is easy to manufacture and of low cost.

The many other objects, features and advantages of the present invention will become apparent to those skilled in the art upon reading the following specification when taken in conjunction with the drawings and claims.

DESCRIPTION OF THE PREFERRED EMBODIMENT

Figure 1A:
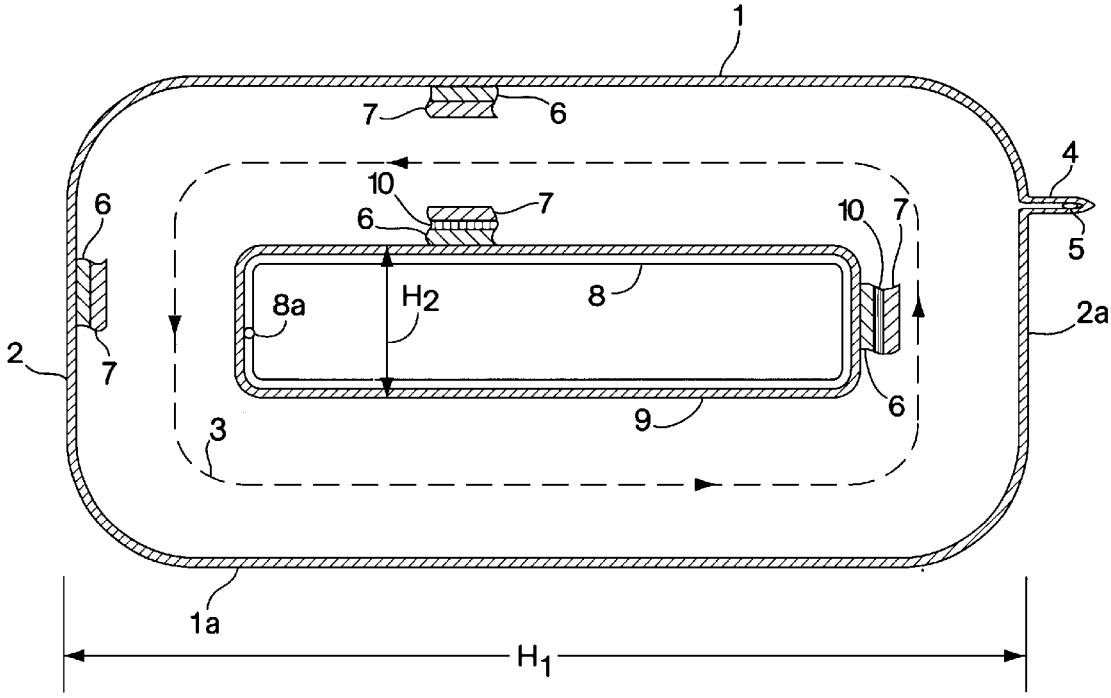
FIGS. 1A and 1B are a schematic diagrams of the first embodiment of the present invention.
Figure 1B:
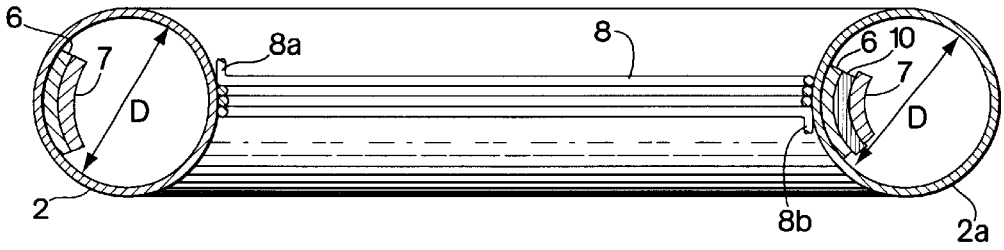

Referring to FIG. 1 (*a,b*) a lamp envelope has a rectangular shape and comprises four glass tubes, 1, 1*a*, 2, and 2*a*, having substantially the same size and shape. Four tubes are connected to each other, thereby forming the closed-loop path 3 for the discharge current, $I_{pl}$ and electric field $E_{pl}$. In a second embodiment (not shown), the envelope has a circular shape and is made from glass tubes of the same diameter.

The envelope is filled with inert gas such as argon, krypton or such. The vapor pressure of mercury is controlled by the temperature of the cold spot located at the end of the exhausting tubulation 4. A small amount of mercury dispenser or amalgam 5 is positioned at the cold spot. The inner surfaces of tubes 1 and 2 are coated with a protective coating 6 and a phosphor coating 7. An induction coil 8 is disposed parallel to the axis on the outer surface of the envelope inside of the closed-loop. The windings are disposed on planes parallel to the axis of the tube. Two coil leads 8*a* and 8*b* connect the coil 8 with a conventional matching network (not shown).

The area of the envelope surface 9 "covered" with the coil depends on the coil wire diameter and number of turns, and can comprise from 1% to 10% of the total envelope surface. The coil 8 blocks the light coming through the walls adjacent to the coil and partially absorbs the light, thereby reducing the total lamp light output. To minimize this effect the area 9 of the envelope inner wall adjacent to the coil is coated with the reflective coating 10 made from $Al_2O_3$, or other conventional reflective material. The light is reflected from the reflective coating 10 and eventually is emitted through the surfaces of the envelope that is not blocked by the coil 8. The coil 8 has white coating to reduce light absorption and to reflect light coming from the envelope, thereby increasing the total light output and also reducing the coil temperature.

For the operation at the high frequency range (0.5 MHz–200 MHz), the coil is made from the copper wire coated with a thin silver coating. A thin white Teflon insulation is used for electrical isolation and to reflect light from the coil. The wire gauge number depends on the tube diameter and can be from #12 (large tube diameter, D is greater than approximately 10 cm) to #20 (small tube diameter, D is greater than approximately 2 cm). The number of turns depends on the operational frequency and varies from 1 turn (f=20–200 MHz) to 15 turns (f=0.5–3.0 MHz). The coil pitch can be from 0 to 20 mm.

For the operation at the low frequency range (0.02 MHz–1 MHz), the coil is made from Litz wire having large number of strands of #38 to #42 gauge. We used Litz wire with number of strands from 50 to 600. Such a wire has very low resistance and high Q-factor (up to 300) at low frequencies of 0.2–0.8 MHz with the maximum of Q=330 at f=400 kHz. The coil pitch can be from 0 to 10 mm. Q-factor can be defined as:

$$Q=2\pi f L_c/R_c,$$

where $L_e$ is coil inductance and $R_c$ is coil resistance.

In the preferred embodiments we used coils with 0 pitch so as to have coils with highest Q-factors and to reduce the envelope surface "covered" with the coil, thereby to increase the envelope radiating surface.

For the operation at a frequency as low as 50–300 kHz, a double layer coil made from Litz wire was used. The maximum of Q-factor of the double coil shifts to lower frequency of 250 kHz and has a value of 400.

The dimensions of the lamp, $H_1$ and $H_2$, and tube diameter, D, depend on the lamp light output and RF power, and are determined by the requirement to the envelope surface area. This area, S, should be large enough so not to be overloaded by the RF power, $P_{pl}$, consumed by the envelope plasma ($P_{pl}/S<200$ mW/cm$^2$).

The same requirements are valid for the dimensions of the second embodiment (circular/ellipsoidal lamp) of the present invention. In the second embodiment, $H_1$ and $H_2$ are the axes of the circular/ellipse envelope and can vary from 1 to 100.

Figure 2A:
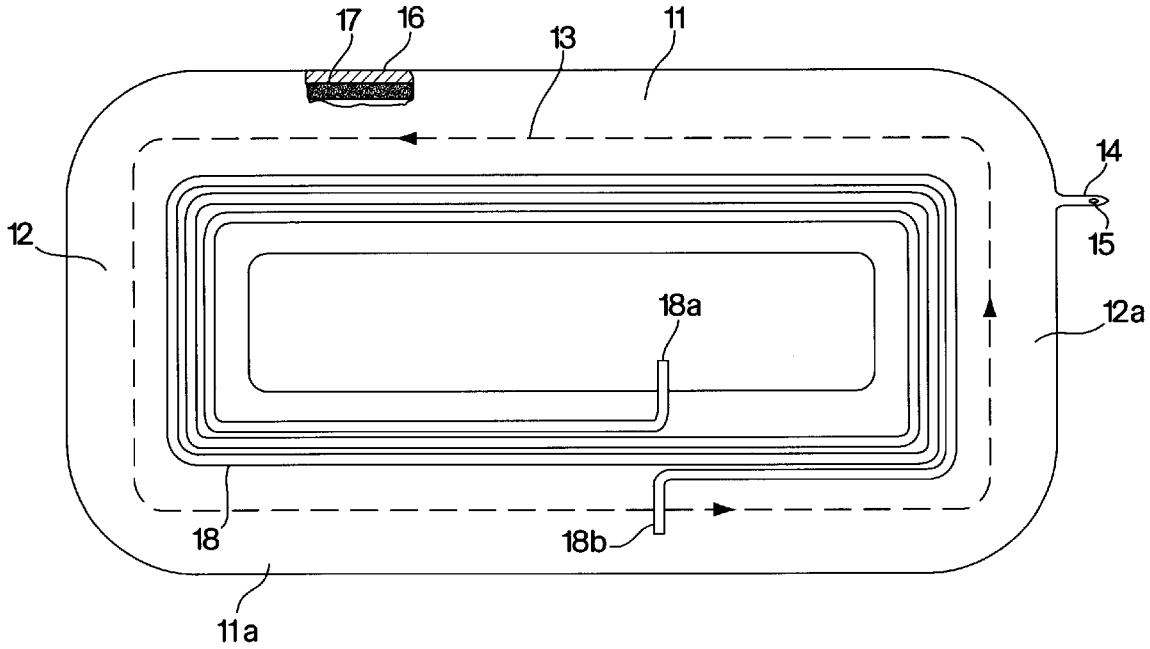
FIGS. 2A and 2B are a schematic diagrams of the third embodiment of the present invention.
Figure 2B:
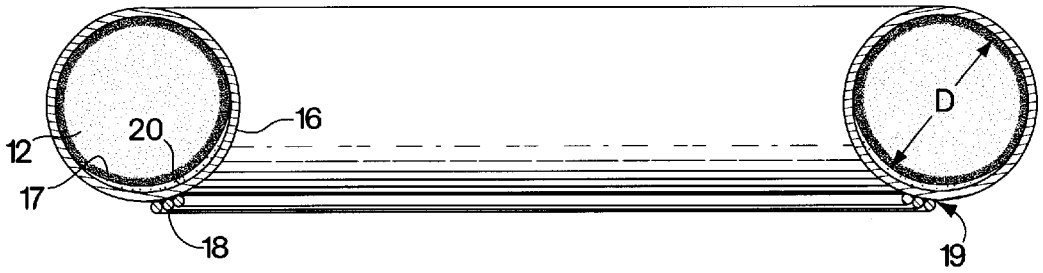

The third embodiment of the present invention is shown in FIG. 2. The envelope of the lamp has rectangular shape and is made from glass tubes 11 and 12 of the same (or close) diameter. The tubes are connected to each other forming a closedloop path 13 for the discharge electric field and discharge current. The envelope is filled with inert gas and mercury vapor pressure that is controlled by the mercury amalgam or dispenser 15 positioned in the tubulation 14. The protective coating 16 and phosphor coating 17 are the same as in FIG. 1.

The induction coil 18 is disposed on the one of the outer surfaces 19 of the envelope as it is shown in FIG. 2. The inner surface 19 of the envelope that is adjacent to the coil 18 is coated with the reflective coating 20 made from $Al_2O_3$ that works in the same manner as it is described in FIG. 1. Two coil leads 18*a* and 18*b* connect the coil 18 with the conventional matching network (not shown).

The envelope of the lamp of the fourth embodiment of the present invention has a circular/ellipsoid shape and the coil 18 is positioned as it is shown in FIG. 2.

Because envelope tubes have the same diameter along the whole discharge path, the plasma electric field, $E_{pl}$, (and its active component, $E_{act}$) have the same magnitudes at any envelope cross section. Therefore, the RF power deposited within the tube cross section, $P_{rf}=I_{pl}E_{act}$, has the same value at any envelope cross section. As a result, the light emitted by the envelope plasma has the same intensity and spectra at any cross section and is very uniform along the whole discharge path. This is an advantage of the closed-loop lamp made from the tubes of the same diameter and shape.

We tested several ferrite-free closed-loop electrodeless fluorescent lamps designed and manufactured in accordance with the present invention that is described above. They were of rectangular shape of different size and were operated at different frequencies and RF powers.

The lamp is operated as follows. The RF voltage is applied to the lamp coil from the RF power source via the matching network. The latter consists of few ceramic (or thin film) high-voltage capacitors connected in series and in parallel. The capacitive discharge is ignited in the envelope at relatively low coil voltage (about 150–200 V). The lamp starting (the appearance of a high brightness inductively coupled plasma) occurs at higher coil voltage, $V_{st}$, that is determined by the starting electric field, $E_{st}$, by the discharge path, $L_{path}$ by the number of turns, $N_{coil}$, and by the coupling coefficient between the coil and plasma, k:

$$V_{st}=V_{pl}N_{coil}/(k)^{1/2}=E_{st}L_{path}N_{coil}/(k)^{1/2}$$

We measured $V_{st}$ in the lamp with the coil disposed on the outer surface of the envelope inside the closed-loop, as it is shown in FIG. 1 (the first embodiment). The coil is made from Litz wire and has 7.2, 10, 12, and 15 turns. We also measured $V_{st}$ in the same lamp, but with the coil disposed on the outer surface of the lamp outside of the closed-loop, as it is shown in FIG. 2 (the third embodiment). Here we used the coil made from copper wire of gauge #14 with silver coating. The number of turns was 3, 5, 7.7, and 11.5 turns. Argon pressure was 0.3 torr, mercury vapor pressure was controlled by the amalgam. The driving frequency range was 0.15–15 MHz.

Figure 3:
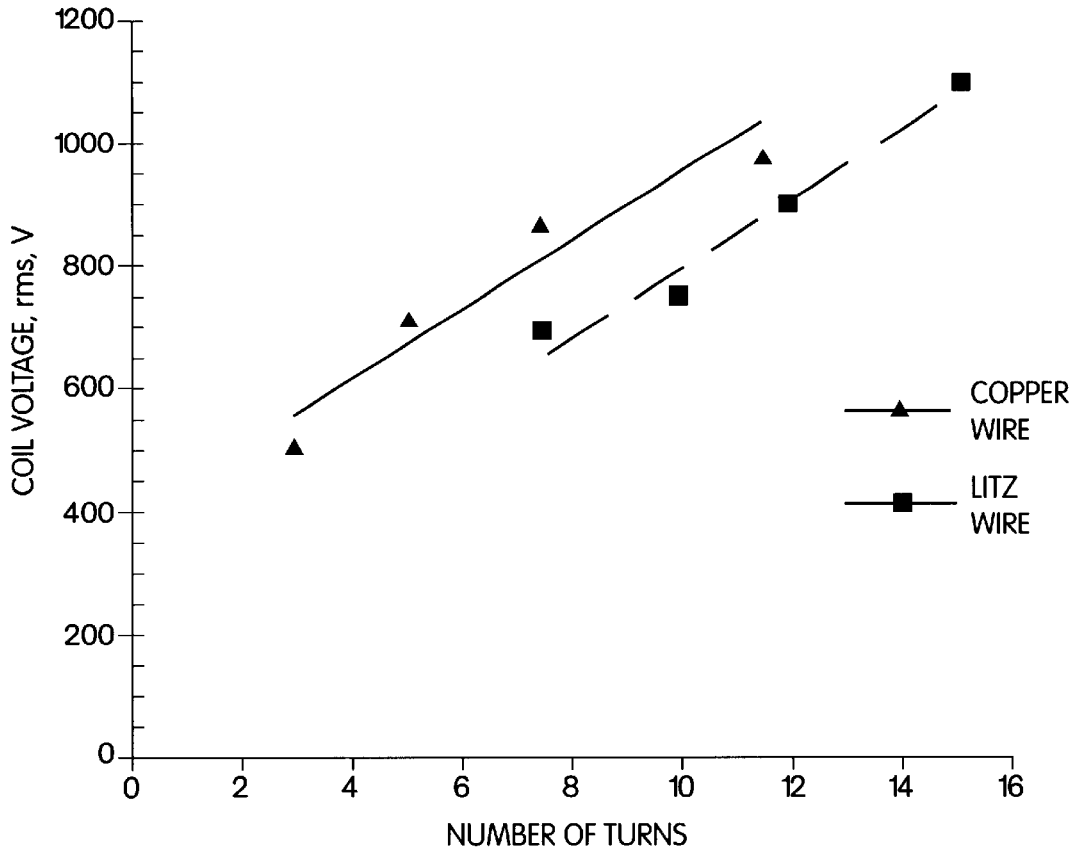
FIG. 3 is the graph showing lamp starting voltages as functions of coil number of turns. The starting voltages were measured in the same lamp that has two different coil arrangements: (1) as it is shown in FIG. 1 (the first embodiment, Litz wire), and (2) as it is shown in FIG. 2 (the third embodiment, copper wire coated with silver). The number of turns varies from 3 to 15.

The results of $V_{st}$ measurements are given in FIG. 3. We did not observe a significant frequency dependence on $V_{st}$, that means that $E_{st}$ also does not depend on frequency as shown in the equation above. It is also seen from the above equation that $V_{st}$ increases almost linearly with $N_{coil}$. It can be also noticed that $V_{st}$ is lower in the lamp operated in accordance with the first embodiment (coil is disposed inside of the closed-loop) than in the lamp operated according to the third embodiment (coil is disposed on the bottom of the lamp). This is probably due to the larger discharge path, $L_{path}$, in the third embodiment than that in the first embodiment.

Figure 4:
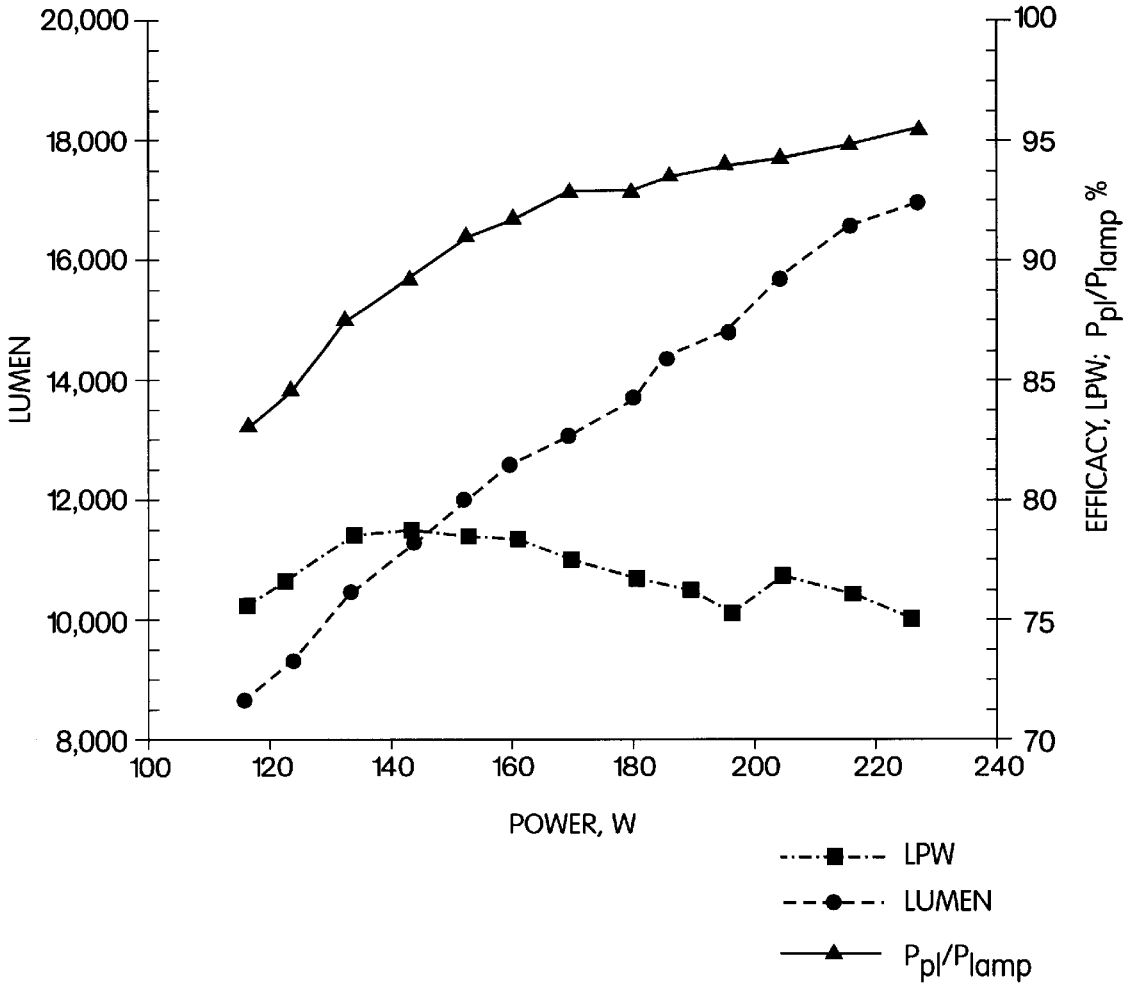
FIG. 4 is the graph showing the total light output (lumens), efficacy, and power efficiency as functions of the RF power consumed by the lamp. The lamp is that shown in FIG. 1 in accordance with the first embodiment of the present invention. The coil has 12 turns and is made from Litz wire that has 450 strands of #40 gauge. As described in U.S. Pat. No. 6,081,070, Litz wire is a well known multiple stranded wire made from metal having high electrical capacity such as copper or silver. Each strand of the wire is electrically isolated and the wire cross-section can be from 0.01 to 0.3 $cm^2$. Such wire has a very low resistance per unit length due to the substantial reduction of the skin-effect. The wire has an electrical and thermal isolation that makes the coil operable at coil temperatures up to 3000° C. The operating frequency is 260 kHz. For operation at low frequencies, f=20 KHz–1 MHz, the induction coil is made from multiple strand wire, often called Litz wire. Each strand is made from metal having a high electrical and thermal conductivity, such as copper or silver. The strands are electrically isolated from each other and the cross section of the strands can be from 0.002 to 0.3 $cm^2$. Such wire has very low resistance per unit length at low frequencies, f<1 MHz, due to the substantial reduction of the skin-effect. The wire has an electrical and thermal isolation that makes the induction coil operable at coil temperatures up to 200° C.

The total lumen output, lamp efficacy (LPW), and RF power losses in the coil are given as functions of the lamp RF power in FIG. 4 for the lamp shown in FIG. 1 and operated at a frequency of f=260 kHz. The lamp dimensions were 33 cm. for $H_1$ and 5 cm. for $H_2$. The diameters of the envelopes were each 5 cm. The coil of 12 turns was made from Litz wire (450 strands of wire #40). The surface area "covered" with the induction coil constitutes 9% of the total envelope surface area. No reflected coating was applied.

It is seen from FIG. 4 that, while the lamp light output (lumens) increases monotonically with RF power, the lamp efficacy (LPW) has a maximum (78 LPW) at P=150 W. Note that similar dependence of efficacy vs. RF lamp power, with its maximum at 150 W, was observed by Godyak et al. (U.S. Pat. No. 5,834,905) in the closed-loop electrodeless lamp operated at the frequency of f=200 kHz, but employing a ferrite core. The decrease of LPW as RF power increases is a known phenomenon associated with the increase of the collision frequency between electrons and excited Hg atoms. The decrease of LPW as RF power decreases is believed to be caused by the drop of the lamp power efficiency due to the increase of RF power loss in the coil. It is illustrated in FIG. 4, where the lamp power efficiency, $\eta=(P_{lamp}-p_{loss})/P_{lamp}=P_{pl}/P_{lamp}$, is plotted vs. lamp power. It is also seen that lamp power efficiency reaches 95% at RF power of 220 W and continues to increase with RF power.

Figure 5:
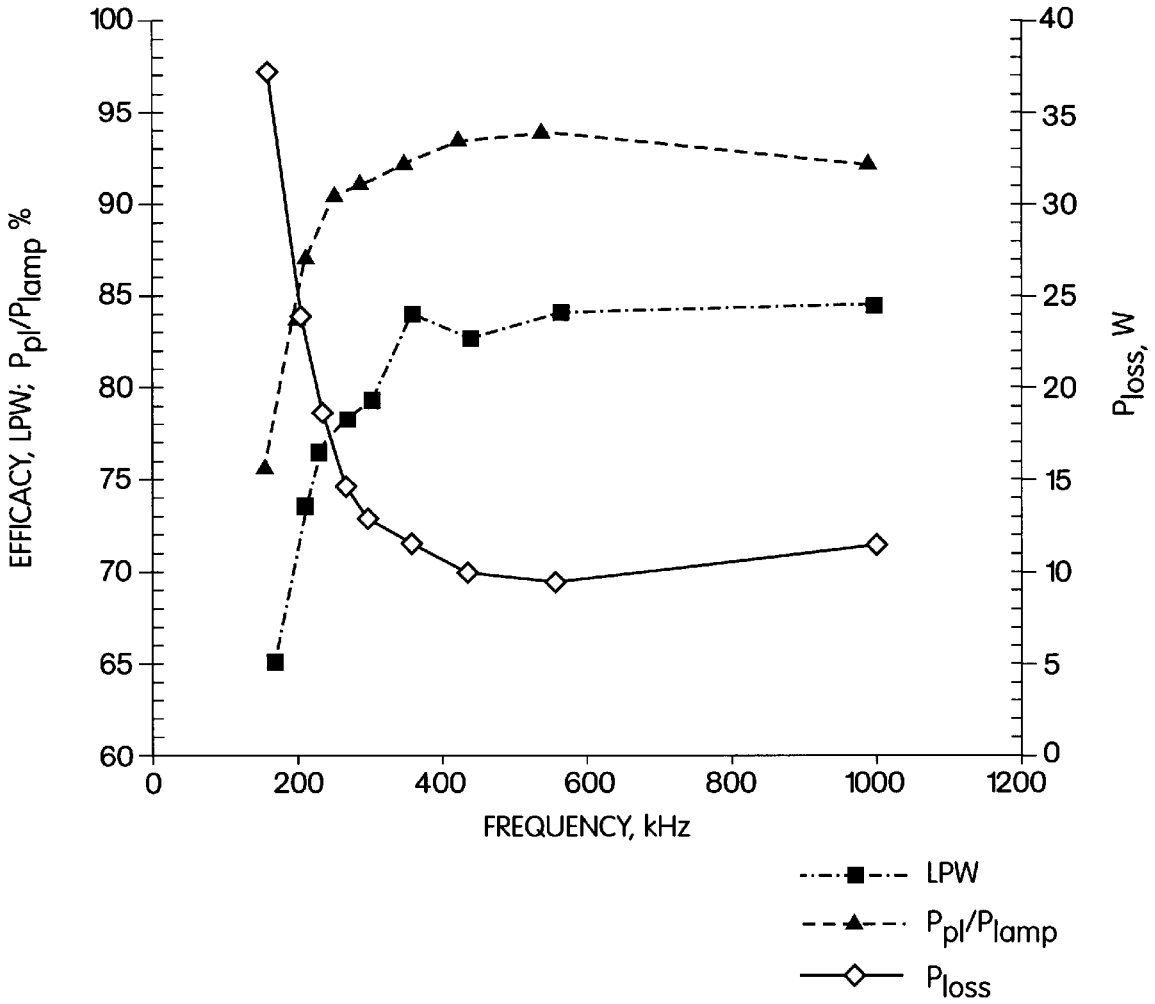
FIG. 5 is the graph showing lamp efficacy, power efficiency, and RF power losses vs. driving frequency. The lamp is that shown in FIG. 1 in accordance with the first embodiment of the present invention. Lamp RF power is 150 W. The coil is made from Litz wire and has the same specification as in FIG. 4.

The increase of the driving frequency leads to the reduction of coil loss so the maximum of the lamp efficacy shifts to the lower lamp power. The dependencies of lamp efficacy (LPW), lamp power efficiency, and coil power loss vs. RF driving frequency are given in FIG. 5 for the same lamp and RF power of 150 W. It is seen that LPW increases rapidly with frequency from 65 LPW at 160 kHz to 84 LPW at 350 kHz and then is practically independent of frequency. The lamp power efficiency, $\eta$, has similar dependence on the frequency, and increases from 75% at 160 kHz to 93% at 350 kHz and then stays practically constant. Consequently, the coil power loss, $P_{loss}$, decreases from 35 W at 160 kHz to 10 W at 350 kHz and, further, stays constant.

Thus, the lamp described in the present invention and operated at 150 W without ferrite core has power efficiency (and, hence, lamp efficacy) slightly lower (4–5%) than that of the lamp described in U.S. Pat. No. 5,834,905. This is due to lower power losses in the lamp described in the cited patent (7–9 W) than in our invention (10–15 W).

At frequencies higher than 1–2 MHz, Litz wire has high resistance and is not suitable for use as induction coil in electrodeless lamps in MHz range. Therefore, for operation at frequencies higher than 1 MHz we used coils made from copper wire with silver coating.

It is apparent that modifications and changes can be made within the spirit and scope of the present invention, but it is my intention, however, to be limited only by the scope of the appended claims.

As my invention, I claim:

1. An electrodeless fluorescent lamp comprising:

a glass lamp envelope formed of a tube in the shape of a closed loop, said tube having an inner surface and an outer surface;

a filling of an inert gas and at least one vaporous metal selected from the group consisting of mercury, cadmium, sodium, the vapor pressure of said metal being below 10 torr during operation;

a protective coating disposed on the inner surface of said envelope;

a phosphor coating disposed on said protective coating;

an induction coil formed of a plurality of parallel windings disposed on the outer surface of said envelope, said windings being disposed on planes parallel to the axis of said tube, said coil covering a small portion of the outer surface of said envelope;

a radio-frequency power source coupled to said induction coil to ignite and maintain RF discharge in said envelope to generate a plasma.

2. The electrodeless fluorescent lamp as defined in claim 1 wherein said plasma consumes more than about 70% of the RF power coupled to said coil.

3. The electrodeless fluorescent lamp as defined in claim 1 wherein a reflective coating is disposed on the inner surface of said envelope surface adjacent to the location of said coil, whereby to reflect light from areas covered by said coil and hide the coil from view.

4. An electrodeless fluorescent lamp as defined in claim 1 wherein said envelope has rectangular shape and comprises four straight tubes of the same diameter connected to each other thereby forming said closed-loop envelope.

5. An electrodeless fluorescent lamp as defined in claim 1 wherein said closed-loop envelope has a circular or elliptical shape and is made from glass tubes having the same diameter at any cross section of said envelope.

6. An electrodeless fluorescent lamp as defined in claim 4 wherein the ratio of the length of the large surface of said rectangular envelope to the small side of said rectangular envelope can be from 1 to 100.

7. An electrodeless fluorescent lamp as defined in claim 5 wherein the ratio of two axes of said elliptical envelope can be from 1 to 100.

8. An electrodeless fluorescent lamp as defined in claim 1 wherein said induction coil is disposed inside the closed loop formed by said envelope.

9. An electrodeless fluorescent lamp as defined in claim 1 wherein said induction coil is disposed on the outer surface of the bottom of said envelope.

10. An electrodeless fluorescent lamp as defined in claim 1 wherein said coil is made from copper wire of 12 to 24 gauge.

11. An electrodeless fluorescent lamp as defined in claim 10 wherein said copper wire is coated with silver.

12. An electrodeless fluorescent lamp as defined in claim 10 wherein said wire has Teflon insulation.

13. An electrodeless fluorescent lamp as defined in claim 1 wherein said coil is made from Litz wire and said Litz wire consists of copper strands of 38 to 42 gauge.

14. An electrodeless fluorescent lamp as defined in claim 13 wherein said Litz wire has 50 to 600 strands.

15. An electrodeless fluorescent lamp as defined in claim 13 wherein said Litz wire is painted with white color.

16. An electrodeless fluorescent lamp as defined in claim 1 wherein said coil has 2 to 15 turns.

17. An electrodeless fluorescent lamp as defined in claim 1 wherein the pitch between turns of said coil is between about 0 to 20 mm.

18. An electrodeless fluorescent lamp as defined in claim 1 wherein said coil has double layers and is wound so currents in adjacent turns of said layers flow in the same direction.

19. An electrodeless fluorescent lamp as defined in claim 1 wherein said coil has triple layers and is wound so currents in adjacent turns of said layers flow in the same direction.

20. An electrodeless fluorescent lamp as defined in claim 1 wherein said RF power is at a frequency from 20 kHz to 200 MHz.

21. An electrodeless fluorescent lamp as defined in claim 1 wherein said RF power can be from 10 W to 2000 W.

* * * * *